US006763789B1

(12) United States Patent
Liang et al.

(10) Patent No.: US 6,763,789 B1
(45) Date of Patent: Jul. 20, 2004

(54) ELECTROMAGNETIC ACTUATOR WITH PERMANENT MAGNET

(75) Inventors: Feng Liang, Canton, MI (US); Michael W. Degner, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 10/249,328

(22) Filed: Apr. 1, 2003

(51) Int. Cl.[7] ..... F01L 9/04

(52) U.S. Cl. ..... 123/90.11; 123/90.24; 251/129.07; 251/129.09; 251/129.16; 335/229; 335/281; 335/295; 335/304

(58) Field of Search ..... 123/90.11, 90.24; 251/129.07, 129.09, 129.16; 335/227, 229, 234, 256, 266, 268, 295, 296, 302, 304, 306, 281; 361/146, 147; 324/76.73; 336/110

(56) References Cited

U.S. PATENT DOCUMENTS

| | | | | | |
|---|---|---|---|---|---|
| 3,683,239 | A | * | 8/1972 | Sturman | 361/194 |
| 4,749,167 | A | * | 6/1988 | Gottschall | 251/65 |
| 4,779,582 | A | | 10/1988 | Lequesne | 123/90.11 |
| 4,829,947 | A | | 5/1989 | Lequesne | 123/90.11 |
| 6,215,206 | B1 | * | 4/2001 | Chitayat | 310/12 |
| 6,334,413 | B1 | | 1/2002 | Hattori et al. | 123/90.11 |
| 6,359,366 | B1 | * | 3/2002 | Liang et al. | 310/263 |
| 6,390,036 | B1 | | 5/2002 | Yuuki | 123/90.11 |
| 6,548,931 | B2 | * | 4/2003 | Liang et al. | 310/156.07 |
| 2002/0041222 | A1 | | 4/2002 | Bauer et al. | 335/256 |
| 2002/0069841 | A1 | | 6/2002 | Miller | 123/90.11 |
| 2002/0069842 | A1 | | 6/2002 | Curtis et al. | 123/90.11 |
| 2002/0069843 | A1 | | 6/2002 | Miller | 123/90.11 |
| 2002/0158218 | A1 | | 10/2002 | Fuwa | 251/129.04 |

* cited by examiner

*Primary Examiner*—Kyle M. Riddle

(57) ABSTRACT

A system and method for increasing force density of a valve actuator particularly suited for use in actuation of intake and/or exhaust valves of an internal combustion engine include at least one electromagnet having a coil wound about a core, and an armature fixed to an armature shaft extending axially through the coil and the core, and axially movable relative thereto. The actuator includes a flux generator, such as at least one permanent magnet positioned between the coil and the armature, oriented so that magnetic flux of the generator travels in a direction opposite to magnetic flux produced by the coil through the core during coil energization to reduce saturation of the core, but in the same direction as the magnetic flux produced by the coil through the armature, to increase an attractive force between the armature and the electromagnet, resulting in an actuator with an increased force density.

22 Claims, 4 Drawing Sheets

ELECTROMAGNETIC ACTUATOR WITH PERMANENT MAGNET

BACKGROUND OF INVENTION

1. Field of the Invention

The present invention relates to a system and method for electronic valve actuation (EVA) using an electromagnetic actuator having a permanent magnet, particularly for actuation of intake and/or exhaust valves of an internal combustion engine.

2. Background Art

Conventional internal combustion engines use a camshaft to mechanically actuate the intake and exhaust valves of the cylinders or combustion chambers. The fixed valve timing of this arrangement, or limited timing adjustment available for variable cam timing systems limits control flexibility. Electronic valve actuation (EVA) offers greater control authority and can significantly improve engine performance and fuel economy under various operating conditions. Electromagnetic actuators are often used in EVA systems to electrically or electronically open and close the intake and/or exhaust valves.

Electromagnetic actuators may use electromagnets or solenoids to attract an armature attached to the valve stem. In a typical application, two opposing magnetic actuators are used in combination with associated springs to control an armature connected to an engine valve stem. The upper actuator provides the upper force that attracts the armature and holds the valve in the closed position while the lower actuator provides the downward force that attracts the armature and holds the valve in the open position. The upper spring pushes the valve downward after the upper actuator is turned off while the lower spring pushes the valve upward after the lower actuator is turned off. The opening and closing or landing speed of the valve is a function of the spring force and the excitation current of the actuator.

Because of the magnetic property of the materials used for the armature and the core in these actuators, the magnetic flux generated by the current supplied to the actuator saturates the magnetic material after the current exceeds a certain level. As a result, the magnetic force of the actuator increases very little once the current reaches the saturation level. For example, in a typical material used for valve actuators in an internal combustion engine, once saturation of the core and armature is reached, an increase of 300% in the excitation current may result in only a 14% increase in the magnetic force.

For many applications, it is desirable to provide fast, controlled valve actuation to improve engine performance without a significant increase in the power consumption of the actuator, which would adversely affect fuel economy. As such, it is desirable to provide actuators having high force density (force/volume), which leads to faster valve actuation and lower power consumption.

Permanent magnets have been used in combination with electromagnets to provide a holding force and/or to increase the magnetic force of the actuator without significant additional power consumption. For example, U.S. Pat. Nos. 4,779,582 and 4,829,947 disclose actuators that have permanent magnets. However, the disclosed constructions having permanent magnets positioned laterally to the outside of the armature of these actuators makes it difficult to control the magnetic flux because the permanent magnets impede the flux produced by the current of the electromagnet. As a result, it may be very difficult to control the armature and valve landing speed, which may result in undesirable noise and/or wear of the valve or valve seat. In addition, the flux through the permanent magnets of these arrangements varies over a wide range as the armature moves. This may lead to undesirable eddy current losses in the permanent magnets. Furthermore, because these actuators are designed to provide a holding force for the armature without any current supplied to the electromagnet, the permanent magnet flux results in a corresponding magnetic force after the current in the coil becomes zero such that the release of the armature from the core is delayed and the power consumption of the actuator is increased.

SUMMARY OF INVENTION

The present invention provides a valve actuator particularly suited for use in actuation of intake and/or exhaust valves of an internal combustion engine. In one embodiment, the actuator includes at least one electromagnet having a coil wound about a core, and an armature fixed to an armature shaft extending axially through the coil and the core, and axially movable relative thereto. The actuator includes at least one permanent magnet positioned between the coil and the armature. The permanent magnet(s) is/are preferably oriented so that magnetic flux of the permanent magnet(s) travels in a direction opposite to magnetic flux generated by the coil through the core to reduce saturation of the core, but in the same direction as the magnetic flux generated by the coil through the armature, to increase an attractive force between the armature and the electromagnet. The actuator may also include a valve that functions as an intake or exhaust valve for an internal combustion engine. The valve includes a valve stem operatively associated with the armature shaft for axial movement therewith. At least one spring is associated with the valve stem or armature shaft to overcome the magnetic attractive force of the permanent magnet and move the armature away from the electromagnet when the electromagnet coil is de-energized. In a typical application, upper and lower electromagnets and springs are provided to open and close the intake/exhaust valve in response to energization of the corresponding upper (close) and lower (open) electromagnet coils.

Alternative embodiments of the present invention include an E-core actuator having a generally oval coil and two rectangular permanent magnets positioned between the coil and the armature, and a pod-core actuator having a generally circular coil and a single annular permanent magnet positioned between the coil and the armature.

The present invention provides a number of advantages. For example, actuators incorporating the present invention have the same flux controllability of conventional actuators because the permanent magnets do not block the flux produced by the current in the coil. As such, the present invention allows acceptable control of the armature speed. The construction of the present invention positions the permanent magnets so the majority of the associated flux travels through the core such that it does not vary significantly as the armature moves. Therefore, the eddy current losses in the permanent magnets are much lower than that of the previous actuators utilizing permanent magnets. Additionally, because most of the permanent magnet flux travels through the core and not to the armature, the magnetic force produced by the permanent magnet flux is very small. Therefore, the armature can be released with little delay and without higher power consumption compared to the conventional actuators.

Positioning of one or more permanent magnets according to the present invention allows the associated flux to travel against the flux produced by the coil in the core, while traveling with the flux produced by the coil in the air gap and through the armature. This reduces saturation of the core while increasing the attractive force of the armature such that the overall magnetic force produced by actuators according to the present invention is significantly higher for the same level of current relative to previous constructions. This increased force production capability can be used to decrease the transition time of the actuator through the use of stiffer springs to provide faster valve actuation, which improves the engine performance, and lower power consumption, which improves the engine fuel economy. Alternatively, the higher force density (force/volume) actuators according to the present invention allow a reduced size/weight actuator.

The above advantages and other advantages, objects, and features of the present invention will be readily apparent from the following detailed description of the preferred embodiments when taken in connection with the accompanying drawings.

DETAILED DESCRIPTION

Figure 1:
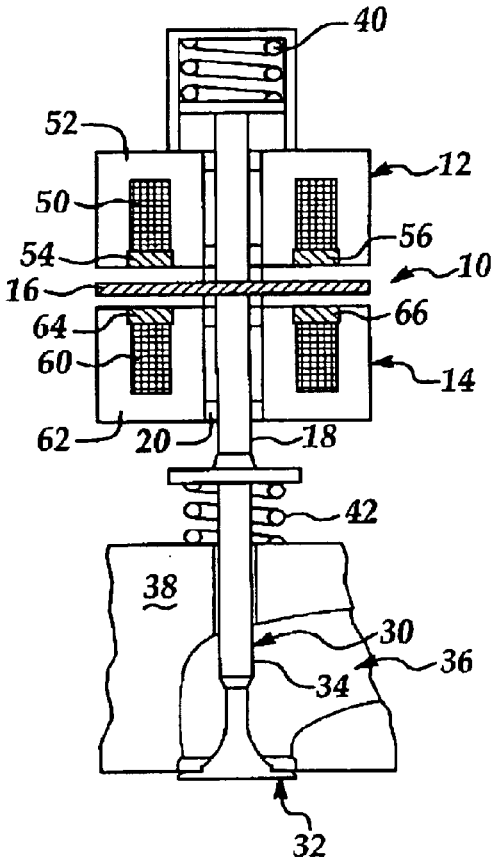
FIG. 1 is a cross-section illustrating one embodiment of a valve actuator assembly for an intake or exhaust valve of an internal combustion engine according to the present invention.

Referring now to the drawings wherein like reference numerals are used to identify similar components in the various views, FIG. 1 is a cross-section illustrating one embodiment of a valve actuator assembly for an intake or exhaust valve of an internal combustion engine according to the present invention. Valve actuator assembly 10 includes an upper electromagnet 12 and a lower electromagnet 14. As used throughout this description, the terms "upper" and "lower" refer to positions relative to the combustion chamber or cylinder with "lower" designating components closer to the cylinder and "upper" referring to components axially farther from the corresponding cylinder. An armature 16 is fixed to, and extends outward from, an armature shaft 18, which extends axially through a bore in upper electromagnet 12 and lower electromagnet 14, guided by one or more bushings, represented generally by bushing 20. Armature shaft 18 is operatively associated with an engine valve 30 that includes a valve head 32 and valve stem 34. Depending upon the particular application and implementation, armature shaft 18 and valve stem 34 may be integrally formed such that armature 16 is fixed to valve stem 34. However, in the embodiment illustrated, shaft 18 and valve stem 34 are discrete, separately moveable components. This provides a small gap between shaft 18 and valve stem 34 when armature 16 is touching upper core 52. Various other connecting or coupling arrangements may be used to translate axial motion of armature 16 between upper and lower electromagnets 12, 14 to valve 30 to open and close valve 30 to selectively couple intake/exhaust passage 36 within an engine cylinder head 38 to a corresponding combustion chamber or cylinder (not shown).

Actuator assembly 10 also includes an upper spring 40 operatively associated with armature shaft 18 for biasing armature 16 toward a neutral position away from upper electromagnet 12, and a lower spring 42 operatively associated with valve stem 34 for biasing armature 16 toward a neutral position away from lower electromagnet 14.

Upper electromagnet 12 includes an associated upper coil 50 wound through a corresponding slot in upper core 52 encompassing armature shaft 18. One or more permanent magnets 54, 56 are positioned substantially between coil 50 and armature 16. The permanent magnet(s) are oriented to reduce saturation of core 52 by generating magnetic flux that travels in a direction opposite to the flux generated during energization of upper coil 50 as explained in greater detail with reference to FIGS. 4 and 5.

Lower electromagnet 14 includes an associated lower coil 60 wound through a corresponding slot in lower core 62 encompassing armature shaft 18. One or more permanent magnets 64, 66 are positioned substantially between lower coil 60 and armature 16. The permanent magnet(s) are oriented to reduce saturation of lower core 62 by generating magnetic flux that travels through lower core 62 in a direction opposite to the flux generated during energization of lower coil 60 as explained in greater detail with reference to FIGS. 4 and 5.

During operation of actuator 10, the current in lower coil 60 is turned off to close valve 30. Bottom spring 42 will push valve 30 upward. Upper coil 50 will be energized when armature 16 approaches upper core 52. The magnetic force generated by upper electromagnet 12 will hold armature 16, and therefore, valve 30 in the closed position. To open valve 30, the current in upper coil 50 is turned off and upper spring 40 will push armature shaft 18 and valve 30 down. Lower coil 60 is then energized to hold valve 30 in the open position.

As will be appreciated by those of ordinary skill in the art, upper and lower electromagnets 12, 14 are preferably identical in construction and operation. However, upper and lower components of the actuator may employ different electromagnet constructions consistent with the present invention depending upon the particular application.

Likewise, the present invention may be used for either the upper or lower portion of the actuator with a conventional construction used for the other portion, although such asymmetrical construction may not provide the benefits or advantages of the present invention to the same degree as a construction (symmetrical or asymmetrical) that uses the principles of the present invention for both the upper and lower components of the actuator.

Figure 2:
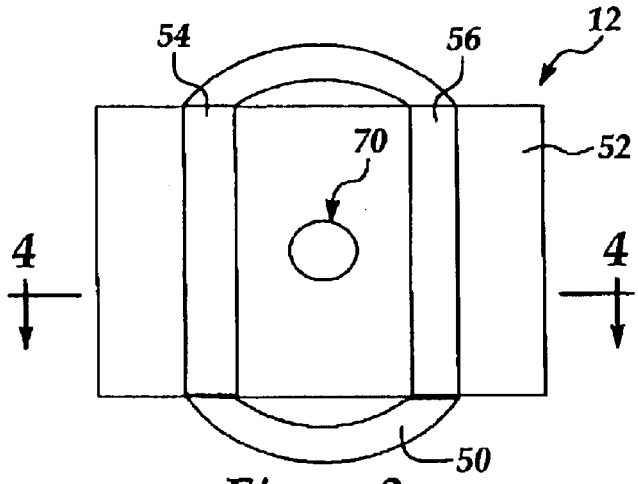
FIG. 2 is a top view of an electromagnet winding and core with a pair of permanent magnets for use in a valve actuator according to one embodiment of the present invention.

FIG. 2 is a top view of an electromagnet winding and core with a pair of permanent magnets for use in a valve actuator according to one embodiment of the present invention. As those of ordinary skill in the art will recognize, the description of upper electromagnet 12 applies to lower electromagnet 14 as well. Electromagnet 12 includes coil SO wound through corresponding slots in core 52 in an oval shape with the coil extending beyond core 52 at the ends. In this embodiment, core 52 is constructed of a plurality of individually laminated stacked plates of a suitable soft magnetic material each generally having an "E" shape with a base and three extensions or prongs forming the two slots for coil 50 with a center through hole 70 to accommodate armature shaft 18 (FIG. 1). Of course, core 52 may also be implemented as a single, unitary piece or solid core of suitable magnetic material depending upon the particular application. In the illustrated embodiment, permanent magnets 54, 56 are used to reduce saturation in core 52 as explained in greater detail with reference to FIGS. 4–7 below.

Permanent magnets 52,54 are positioned within corresponding slots of the E-shaped core directly above coil 50. As such, when the actuator is assembled, permanent magnets 54, 56 extend between coil 50 and armature 16 (FIG. 1). As shown in FIG. 2, it is not necessary for permanent magnets 54, 56 to cover the entire extent of coil 50 as long as the permanent magnets are properly oriented to generate flux through core 52 in a direction opposite to flux generated by coil 50 traveling through core 52. Likewise, one or more permanent magnets, or other devices that generate the appropriate flux, may be used in keeping with the teachings of the present invention.

In one embodiment of the present invention, permanent magnets 54, 56 are parallelepipeds or generally bar-shaped magnets. Permanent magnets 54, 56 are preferably placed directly on top of coil 50 to cover a substantial portion of coil 50 that extends across armature 16 (FIG. 1.).

Figure 3:
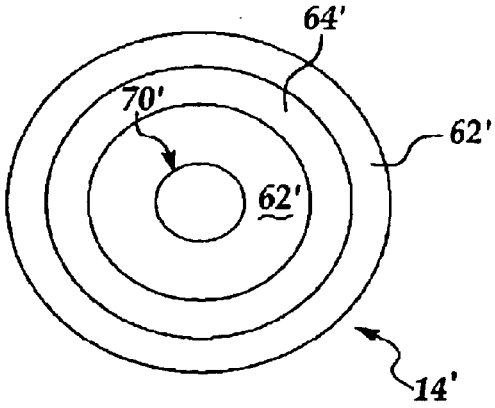
FIG. 3 is a top view of an electromagnet winding and core with an annular permanent magnet for use in a valve actuator according to another embodiment of the present invention.

FIG. 3 is a top view of an electromagnet winding and core with an annular permanent magnet for use in a valve actuator according to another embodiment of the present invention. Electromagnet 14' includes a solid pod-shaped core 62' constructed of a suitable magnetic material. Core 62' includes an annular slot adapted to receive a coil (not shown) and an annular permanent magnet 64'. A center through hole 70' is provided to accommodate axial travel of armature shaft 18 (FIG. 1). In this embodiment, annular magnet 64' is disposed directly on top of the coil. As such, when assembled in an actuator, permanent magnet 64' extends between the coil and the armature.

Figure 4:
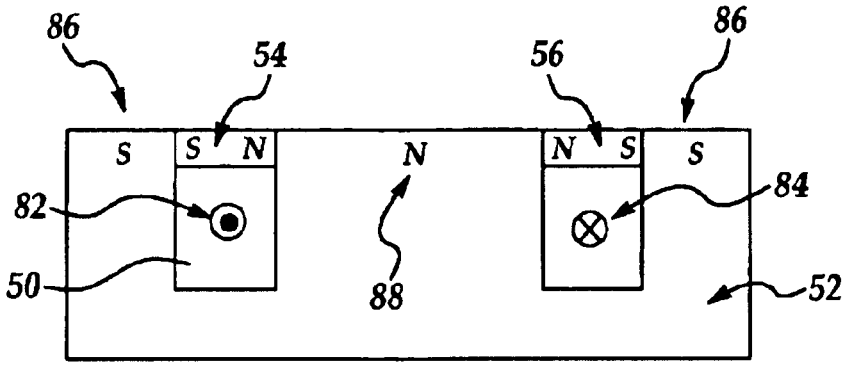
FIG. 4 is a representative cross-section of either embodiment illustrated in FIG. 2 or FIG. 3 illustrating orientation of the permanent magnet(s) relative to an associated electromagnet coil current flow.

FIG. 4 is a representative electromagnet/permanent magnet cross-section taken along line 4—4 of the embodiment illustrated in FIG. 2. Although described with reference to FIG. 2, those of ordinary skill in the art will recognize that the cross-section of FIG. 4 would appear identical to a similar cross-section taken through the pod-core electromagnet illustrated in FIG. 3 with the primary difference being the permanent magnet(s) 54, 56 which are bar magnets in the construction of FIG. 2, but a single annular magnet in the construction of FIG. 3. FIG. 4 illustrates one possible orientation or polarity of the permanent magnet(s) relative to an associated current flow through the electromagnet coil. The core represents an E-shaped core (solid or laminated construction) 52 having a slot or slots for bar-shaped permanent magnets 54, 56.

Coil 50 includes a number of windings of a current conductor. During energization of coil 50, current flows out of the plane of the paper as represented by "dot" 82 and into the plane of the paper as represented by "x" 84. The current flow generates a magnetic flux through the core as illustrated and described with reference to FIG. 5, creating a center magnetic north (N) pole 88 and two magnetic south (S) poles 86. Permanent magnets 54, 56 are oriented with their south (S) poles nearest or proximate the south (S) pole of the core and their north (N) poles proximate the north (N) pole of the core. Of course, other orientations of the permanent magnets and current flow are possible. For example, one alternative arrangement changes both the current direction and the orientation/polarity of the permanent magnets such that current would be flowing into the page at 82 and out of the page at 84 with the magnetic polarities reversed (N changed to S and S changed to N in each instance). Those of ordinary skill in the art may recognize other arrangements within the scope of the invention depending upon the particular application and implementation.

Figure 5:
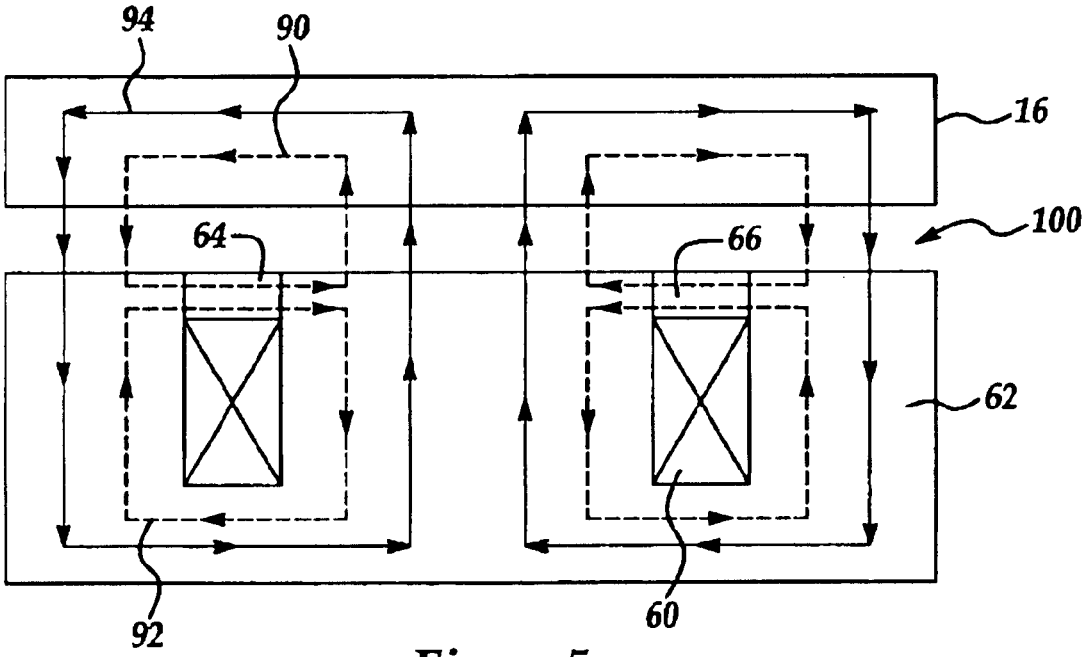
FIG. 5 is another representative cross-section of an actuator according to the present invention illustrating magnetic flux paths through the armature and core for flux associated with the permanent magnet(s) and flux associated with energization of the coil.

FIG. 5 is a representative cross-section of a portion of an actuator assembly according to the present invention illustrating magnetic flux paths through the armature and core for flux associated with the permanent magnet(s) and flux associated with energization of coil 60 (FIG. 4). As described above with respect to the cross-section illustrated in FIG. 4, although the cross-section of FIG. 5 is described with reference to an E-core construction, FIG. 5 represents both the E-core and pod-core embodiments illustrated in FIGS. 2 and 3. Permanent magnets 64, 66 provide a magnetic flux that travels through air gap 100 and armature 16 as represented generally by reference numeral 90, while providing a magnetic flux that travels through core 62 in the direction indicated by path 92. When coil 60 is energized, current passes through coil 60 as described with reference to FIG. 4 to generate magnetic flux through core 62 as indicated generally by path 94. As such, the magnetic flux generated by permanent magnets 64, 66 travels through core 62 in a direction opposite to the magnetic flux associated with energization of coil 60, while traveling in the same direction through air gap 100 and armature 16. The magnetic flux generated by permanent magnets 64, 66 traveling through core 62 cancels the flux produced by the current to some extent, which reduces saturation within core 62. At the same time, the permanent magnet flux traveling through air gap 100 and armature 16 in the same direction as the magnetic flux produced by the coil increases the magnetic attractive force between the electromagnet and armature 16.

As illustrated in FIG. 5, most of the magnetic flux produced by permanent magnets 64, 66 travels through core 62, rather than through air gap 100 and armature 16. The corresponding magnetic attractive force is therefore relatively small. Preferably, permanent magnets 64, 66 do not generate enough flux to hold armature 16 in either the valve open or valve closed position against a corresponding core when there is no current, i.e. when the coil is de-energized. This is one advantage of the present invention in that the spring force will release the armature when the current to the coil is turned off. The armature, and therefore, the associated valve, is held in the open/closed position primarily by the magnetic force produced by the current in the lower coil (for open position) or upper coil (for closed position). Without any current in either coil, the valve will be in a neutral position with the armature about midway between the upper and lower electromagnets.

Figure 6:
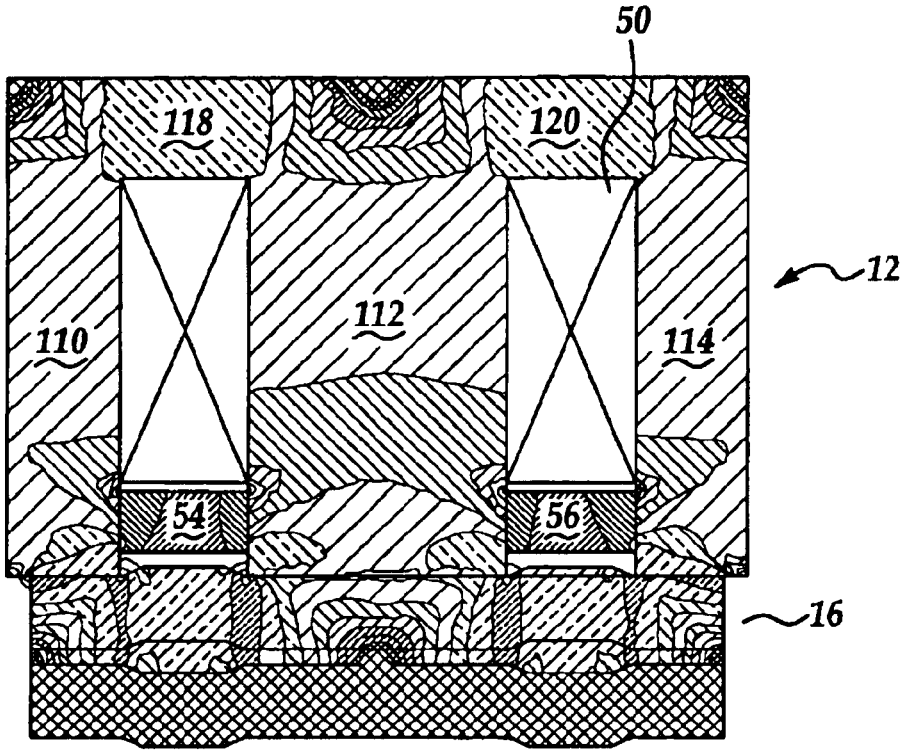
FIG. 6 is a finite element model of a representative cross-section through an actuator according to one embodiment of the present invention illustrating reduced saturation of the core for the same coil current relative to the prior art construction illustrated in FIG. 7.
Figure 7:
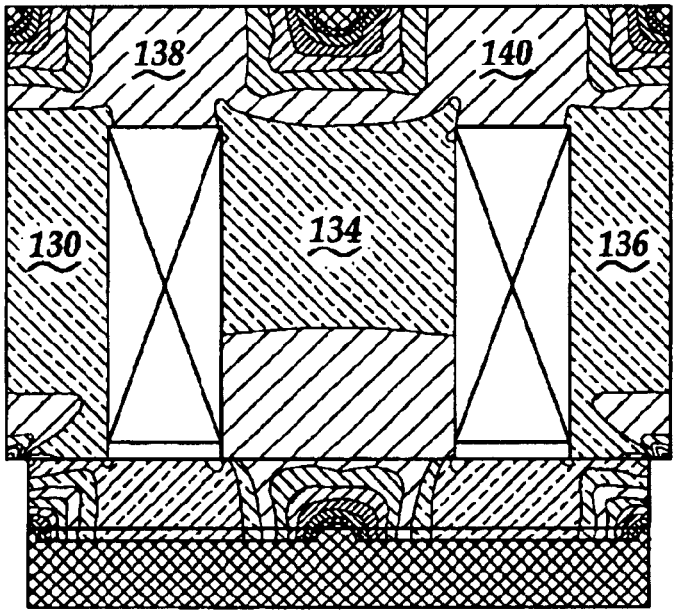
Figure 7 Prior Art
FIG. 7 is a finite element model of a representative cross-section through a prior art actuator illustrating core saturation.

FIGS. 6 and 7 illustrate flux density distribution of an actuator according to the present invention relative to a prior art actuator, respectively, based on corresponding finite element models with the same coil excitation current. FIG. 6 is a finite element model of a representative cross-section through an actuator having permanent magnets according to one embodiment of the present invention with armature 16 in contact with the core. FIG. 7 is a finite element model of a prior art actuator without permanent magnets with the armature in contact with the core. In the prior art actuator shown in FIG. 7, regions generally represented by reference numerals 130, 134, and 136 in the core have reached saturation, while regions 138 and 140 have not reached saturation. Corresponding regions 110, 112, and 114 in the core of the actuator constructed with permanent magnets according to the present invention as shown in FIG. 6 show a reduced flux density and have not reached saturation. However, regions 118 and 120 have reached saturation.

Comparison of the flux density distributions illustrated in FIGS. 6 and 7 indicates that the permanent magnets of the present invention have lowered the flux density over a comparatively large region of the core. As such, the actuator of FIG. 6 according to the present invention has a higher magnetic force with the same current and the same size compared with the conventional actuator illustrated in FIG. 7, as illustrated by the graph of FIG. 8.

Figure 8:
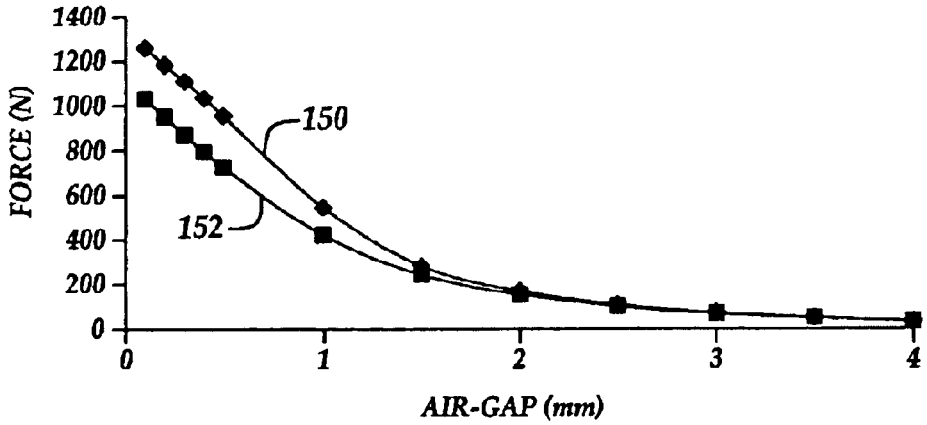
FIG. 8 is a graph illustrating the improvement in magnetic force of an actuator constructed according to the present invention relative to a prior art actuator for a given coil current.

The graph of FIG. 8 illustrates the improvement in magnetic force as a function of the air gap for an actuator constructed according to the present invention relative to a prior art actuator of the same size for a given coil current. Line 150 represents the magnetic force generated by an actuator having permanent magnets according to the present invention, while line 152 represents the magnetic force generated by a prior art actuator. The actuator of the present invention produces a significantly higher (about 18%) for the same current level. The increased force production capability can be used to decrease the transition time of the actuator through the use of stiffer springs, or alternatively to reduce the size of the actuator because it has a higher force density (force/volume).

Figure 9:
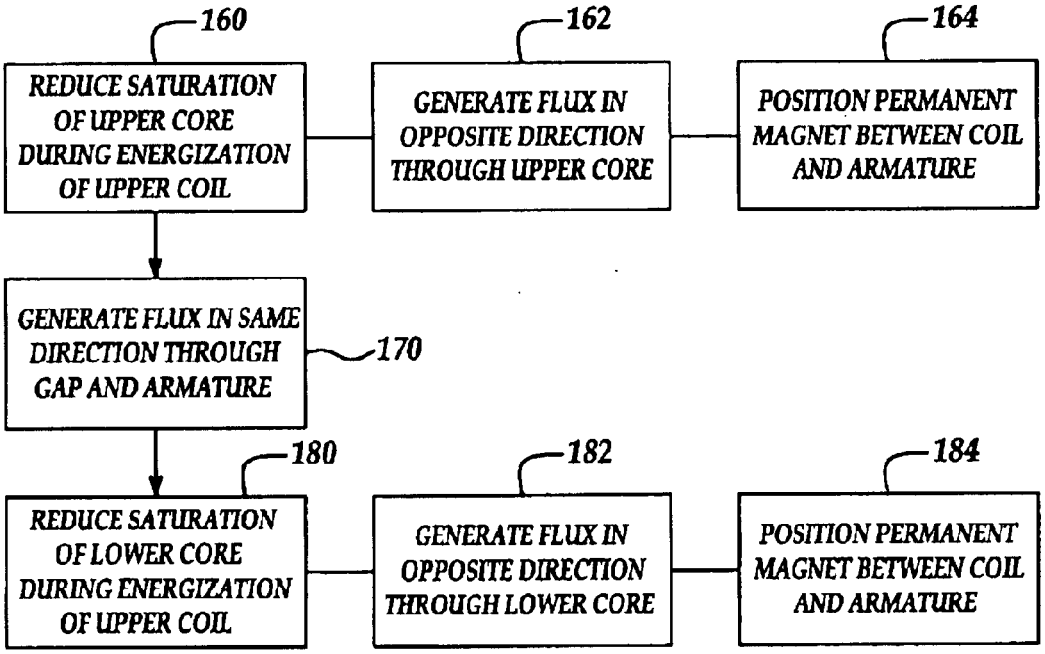
FIG. 9 is a flow chart illustrating a method for increasing electromagnetic valve actuator force density by reducing core saturation and increasing magnetic attraction force according to one embodiment of the present invention.

FIG. 9 is a flow chart illustrating a method for increasing electromagnetic valve actuator force density by reducing core saturation and increasing magnetic attraction force according to one embodiment of the present invention. The method is preferably used for actuating intake and/or exhaust valves of an internal combustion engine having electronic valve actuators including upper and lower electromagnets having corresponding upper and lower coils passing through respective upper and lower cores for moving an armature therebetween. The armature is preferably operatively associated with an intake or exhaust valve to open and close the valve in response to energization of the lower and upper coils, respectively. As represented by block 160, in this embodiment the method includes reducing saturation of the upper core during energization of the upper coil while increasing magnetic flux passing through the armature. Saturation in the core may be reduced by generating magnetic flux traveling in an opposite direction through the upper core as represented by block 162. Positioning a permanent magnet between a substantial portion of the coil and armature can generate appropriate magnetic flux as represented by block 164, for example.

The method also preferably includes generating magnetic flux through the air gap and armature in the same direction as flux associated with energization of the upper coil to increase a magnetic attractive force of the upper coil, and generating magnetic flux through the air gap and armature in the same direction as flux associated with energization of the lower coil to increase a magnetic attractive of the lower coil as represented by block 170. Reducing overall flux density in the lower core during energization of the lower coil is represented by block 180. This may be accomplished by generating flux traveling through the lower core in a direction opposite to the flux generated by the lower coil as represented by block 182. One or more permanent magnets may be positioned between the lower coil and the armature to generate the appropriate magnetic flux as represented by block 184.

Thus, the present invention provides an actuator having the same flux controllability of conventional actuators by positioning the permanent magnets so that they do not block flux produced by the current in the coil as it travels through the air gap and armature. As such, the armature speed and associated valve landing speed is more controllable. The permanent magnet flux of the actuators according to the present invention does not vary over a wide range as the armature moves because the majority of the flux travels through the core. Therefore, the eddy current loss in the permanent magnet material is much lower than that of the previous actuators utilizing permanent magnets. Furthermore, the magnetic force produced by the permanent magnet flux according to the present invention is very small because most of the permanent magnet flux does not travel to the armature. As such, the armature can be released with little delay and the without increased power consumption.

While the best mode for carrying out the invention has been described in detail, those familiar with the art to which this invention relates will recognize various alternative designs and embodiments for practicing the invention as defined by the following claims.

What is claimed:

1. A valve actuator for an internal combustion engine, comprising:

at least one electromagnet having a coil wound about a core;

an armature fixed to an armature shaft extending axially through the coil and the core, and axially movable relative thereto; and at least one permanent magnet extending between the coil and the armature, wherein the at least one permanent magnet is oriented so that associated magnetic flux travels in a direction opposite to magnetic flux generated by the coil through the core to reduce saturation of the core during energization of the coil, but in the same direction as the magnetic flux generated by the coil through the armature, to increase an attractive force between the armature and the electromagnet.

2. The actuator of claim 1 wherein the at least one permanent magnet comprises a parallelepiped.

3. The actuator of claim 2 wherein the at least one permanent magnet comprises a pair of parallelepipeds positioned substantially parallel to one another equidistant from a center of the coil.

4. The actuator of claim 1 wherein the at least one permanent magnet comprises an annular magnet.

5. A valve actuator for an internal combustion engine, comprising:

at least one electromagnet having a coil wound about a core;

an armature fixed to an armature shaft extending axially through the coil and the core, and axially movable relative thereto; and at least one permanent magnet extending between the coil and the armature, wherein the at least one electromagnet comprises an upper electromagnet having an associated upper coil and upper core disposed axially above the armature and having at least one associated permanent magnet extending between the upper coil and the armature, and a lower electromagnet having an associated lower core and lower coil disposed axially below the armature and having at least one associated permanent magnet extending between the lower coil and the armature.

6. The actuator of claim 5 further comprising:

upper and lower springs for biasing the armature toward a neutral position between the upper and lower electromagnets when neither the upper nor the lower electromagnet is energized.

7. The actuator of claim 1 wherein the armature extends outward beyond the at least one permanent magnet.

8. A valve actuator assembly for actuation of an internal combustion engine intake or exhaust valve, the valve actuator assembly comprising:

an upper electromagnet having an upper coil wound about an upper core;

a lower electromagnet having a lower coil wound about a lower core;

an armature fixed to an armature shaft, the armature shaft extending axially through the upper and lower coils and axially movable relative thereto;

at least one upper permanent magnet disposed within a corresponding slot of the upper core and extending between the upper coil and the armature;

an upper spring for biasing the armature shaft away from the upper electromagnet when the upper coil is de-energized;

at least one lower permanent magnet disposed within a corresponding slot of the lower core and extending between the lower coil and the armature; and a lower spring for biasing the armature shaft away from the lower electromagnet when the lower coil is de-energized.

9. The valve actuator assembly of claim 8 wherein the at least one upper permanent magnet comprises a pair of permanent magnets oriented so that associated magnetic flux travels in a direction opposite to magnetic flux generated by the upper coil through the upper core during energization of the upper coil, but travels in the same direction as the magnetic flux generated by the upper coil through the armature; and wherein the at least one lower permanent magnet comprises a pair of permanent magnets oriented so that associated magnetic flux travels through the lower core in a direction opposite to magnetic flux generated by the lower coil during energization of the lower coil, but travels in the same direction through the armature as the magnetic flux generated by the lower coil.

10. The valve actuator assembly of claim 9 wherein the upper and lower permanent magnet pairs comprise bar magnets.

11. The valve actuator assembly of claim 10 wherein the upper permanent magnets are positioned generally parallel to one another and generally equidistant from a center of the upper core; and wherein the lower permanent magnets are positioned generally parallel to one another and generally equidistant from a center of the lower core.

12. The valve actuator assembly of claim 8 wherein the upper and lower permanent magnets comprise annular magnets.

13. The valve actuator assembly of claim 12 wherein the upper and lower permanent magnets are generally centered about the armature shaft and disposed within corresponding slots of the upper and lower cores, respectively.

14. A method for actuating an intake or exhaust valve of an internal combustion engine having an electronic valve actuator including an electromagnet having a coil passing through a core for moving an armature associated with the valve to move the valve in response to energization of the coil, the method comprising:

reducing saturation of the core during energization of the coil while increasing magnetic flux passing through the armature.

15. The method of claim 14 wherein the step of reducing saturation of the core comprises generating magnetic flux traveling through the core in a direction opposite to the magnetic flux produced by the coil traveling through the core.

16. The method of claim 15 wherein the step of generating magnetic flux through the core comprises positioning at least one permanent magnet between the coil and the armature.

17. The method of claim 16 wherein the at least one permanent magnet comprises a pair of bar magnets.

18. The method of claim 16 wherein the at least one permanent magnet comprises an annular magnet.

19. The method of claim 14 wherein the electronic valve actuator further comprises a second electromagnet having a corresponding second coil passing through a second core for moving the armature between the first and second cores in response to energization of the first and second coils, respectively, the method further comprising:

reducing saturation of the second core during energization of the second coil while increasing magnetic flux passing through the armature.

20. The method of claim 19 wherein the step of reducing saturation of the second core comprises positioning at least one permanent magnet between the second coil and the armature.

21. The method of claim 20 wherein the at least one permanent magnet comprises a pair of bar magnets.

22. The method of claim 20 wherein the at least one permanent magnet comprises an annular magnet.

* * * * *